US009808043B2

(12) United States Patent
Vance et al.

(10) Patent No.: US 9,808,043 B2
(45) Date of Patent: Nov. 7, 2017

(54) PROTECTIVE FLUIDIC-TRANSFER HELMET

(71) Applicants: Jared Vance, Westminster, MD (US); Benjamin Arbaugh, Westminster, MD (US)

(72) Inventors: Jared Vance, Westminster, MD (US); Benjamin Arbaugh, Westminster, MD (US)

( * ) Notice: Subject to any disclaimer, the term of this patent is extended or adjusted under 35 U.S.C. 154(b) by 158 days.

(21) Appl. No.: 14/837,572

(22) Filed: Aug. 27, 2015

(65) Prior Publication Data

US 2016/0058094 A1 Mar. 3, 2016

Related U.S. Application Data

(60) Provisional application No. 62/043,348, filed on Aug. 28, 2014.

(51) Int. Cl.
*A42B 3/00* (2006.01)
*A42B 3/12* (2006.01)

(52) U.S. Cl.
CPC ..... *A42B 3/122* (2013.01)

(58) Field of Classification Search
CPC ..... A42B 3/121; A42B 3/122; A63B 71/10
See application file for complete search history.

(56) References Cited

U.S. PATENT DOCUMENTS 3,761,959 A 10/1973 Dunning
4,038,700 A 8/1977 Gyory
5,014,365 A 5/1991 Schulz
5,083,320 A 1/1992 Halstead
5,175,889 A 1/1993 Infusino
5,263,203 A 11/1993 Kraemer et al.
5,349,702 A * 9/1994 Runckel ..... A42B 1/12 2/171
6,065,159 A 5/2000 Hirsh
6,178,560 B1 * 1/2001 Halstead ..... A42B 3/122 2/413
6,219,850 B1 * 4/2001 Halstead ..... A42B 3/06 2/414
8,540,838 B2 9/2013 Millette et al.
(Continued)

*Primary Examiner* — Khaled Annis
(74) *Attorney, Agent, or Firm* — Baker Donelson, PC; Royal W. Craig

(57) ABSTRACT

A protective helmet with outer hard plastic shell and internal inflatable bladder arrayed in a particular semi-elliptical fluidic circuit of known elasticity and defined pattern. The bladder is a long thin TPE rubber tube having a valve mounted centrally at mid-length. The tube is mounted inside the hard plastic shell such that the valve protrudes centrally through the hard shell and outward just beneath the occipital bone at the rear of the wearer's head. Inside the tube bisects into equal-length non-return fluidic patterns one on the right-side of the head and one on the left. Each fluidic pattern comprises a semi-ellipse, running continuously up to the temple and looping up and around from temporal-to-frontal-to-parietal sections of the human head, and terminating approximately at the occipital portion. Mesh netting is provided over the tube as a liner layer against the head. The invention vastly improves impact protection, yet is light-weight, flexible, and comfortable to wear on a continuous basis.

19 Claims, 3 Drawing Sheets

(56) References Cited

U.S. PATENT DOCUMENTS

| | | | | |
|---|---|---|---|---|
| 9,032,558 | B2 * | 5/2015 | Leon | A42B 3/12 2/411 |
| 2002/0166157 | A1 * | 11/2002 | Pope | A42B 3/122 2/413 |
| 2003/0135914 | A1 | 7/2003 | Racine | |
| 2004/0205880 | A1 * | 10/2004 | Sacree | A42B 3/122 2/413 |

* cited by examiner

PROTECTIVE FLUIDIC-TRANSFER HELMET

CROSS-REFERENCE TO RELATED APPLICATION(S)

The present application derives priority from U.S. provisional application Ser. No. 62/043,348 filed Aug. 28, 2014.

BACKGROUND OF THE INVENTION

1. Field of the Invention

The invention relates generally to sports-related protective equipment, and more particularly, to a protective helmet for sports such as football, lacrosse, hockey and baseball that increases impact-resistance by an improved fluidic transfer circuit.

2. Description of the Background

The most vulnerable part of the body in most any sport is the head. For example, in football, players' heads are routinely subjected to other helmets, shoulder pads or the ground. Football players are, of course, required to wear protective helmets. These helmets generally comprise bard-shell plastic with interior foam padding. However, the localized open- or closed-cell padding tends to transfer the impact to a localized area of the head. The present inventors have found that a fluidic transfer system can spread the impact transfer and thereby improve protection.

Inflatable helmet liners for protective headgear are known, largely to provide a way for a single helmet to be fit to a wider range of head sizes. These tend to employ discrete inflatable pads which, though capable of fitting a wider range of head sizes, do not improve impact protection over conventional foam pads.

For example, U.S. Pat. No. 5,175,889 to Infusino issued Jan. 5, 1993 (Riddell) shows an inflatable liner for varying the size of protective headgear. A valve 40 at the back inflates a tube that lines the protective headgear and partially encircle a user's head.

U.S. Pat. No. 5,083,320 to Halstead (Athletic Helmet, Inc.) issued Jan. 28, 1992 shows a protective helmet with self-contained air pump.

United States Patent Application 20030135914 to Racine published Jul. 24, 2003 shows a hockey helmet comprising an H-shaped inflatable bladder. The patent is drawn to the layout of the bladder, including crown region, left and right temple regions, left and right side regions and an occipital region.

U.S. Pat. No. 5,014,365 to Schulz (Maxpro Helmets, Inc,) issued May 14, 1991 shows a helmet with an inflatable bladder on the interior of the helmet.

U.S. Pat. No. 6,065,159 to Hirsh (United Sports Gear, Inc.) filed May 23, 2000 shows a protective helmet with inflatable cushions.

U.S. Pat. No. 3,761,959 to Dunning issued Oct. 2, 1973 shows an early patent for inflatable padding for a helmet.

U.S. Pat. No. 5,263,203 to Kraemer et al. (Riddell) issued Nov. 23, 1993 shows an integrated pump mechanism and inflatable liner for protective headgear and partially encircles a user's head. The claims require a pump accessible via the earholes.

U.S. Pat. No. 4,038,700 to (livery issued Aug. 2, 1977 shows a safety helmet for motorcyclists with a plurality of air cushions interconnected by tubes.

U.S. Pat. No. 8,540,838 to Millette et al. (Reebok) issued Sep. 24, 2013 shows inflatable Mylar bladders for use helmets.

Clearly, manufacturers are continually striving to improve the impact resistance of protective headwear. However, they tend to rely on isolated interior padding that does not allow impact force to be absorbed throughout the entire area of the helmet. Whatever force is transmitted inward from the hard outer shell remains concentrated on a limited island of padding directly there beneath. This offers marginal protection. The present inventors conducted extensive impact studies to more fully understand the dynamics of a sports-related head impact. Due to momentum, impact to the head initially causes the brain to compress against the skull at the point of impact, after which it rebounds, moves rapidly in the opposite direction, and compresses against the skull on the opposing side. Conventional padding is not dynamic and does not provide adaptive cushioning that anticipates the area of impact. However, the present inventors have found that a particular fluidic circuit defined by a single curvilinear tube of particular elasticity and arrayed in a particular pattern dissipates impact transfer to a greater extent, thereby improving protection In addition, the improved fluidic-transfer helmet is lightweight, flexible, and comfortable against the skin, provides adequate ventilation allowing the user to dissipate heat and moisture, and is more comfortable to wear on a continuous basis.

SUMMARY OF THE INVENTION

Accordingly, it is an object of the present invention to provide a protective helmet with internal inflatable bladder arrayed in a particular fluidic circuit that dissipates impact.

It is another object to provide a protective helmet with inflatable bladder arrayed in a single curvilinear tube of known elasticity and defined pattern for improved impact protection.

It is still another object to provide an improved fluidic-transfer helmet that is lightweight, flexible, and comfortable to wear on a continuous basis.

In accordance with the above-described object, an embodiment of the present invention is a protective football helmet with outer hard plastic shell and internal inflatable bladder arrayed in a particular fluidic circuit arrayed in a single curvilinear tube of known elasticity and defined pattern. The tube is a long thin rubber tube having a valve mounted centrally at mid-length. The tube is formed of lightweight TPE (a thermoplastic elastomer compound). The tube is mounted inside the hard plastic shell such that the valve protrudes centrally through the hard shell and outward just beneath the occipital bone at the rear of the wearer's head. Inside the tube bisects into equal-length non-return fluidic patterns one on the right-side of the head and one on the left. Each fluidic pattern comprises a semi-ellipse, running continuously up to the temple and looping up and around from temporal-to-frontal-to-parietal sections of the human head, and terminating approximately at the occipital portion. The tube sections are preferably bonded directly to the inner surface of the hard shell. In addition, mesh netting is provided over the tube as a liner layer against the head. The invention vastly improves impact protection, yet is lightweight, flexible, and comfortable to wear on a continuous basis.

The above and other objects, features and advantages of the present invention will become readily apparent twin the following detailed description thereof which is to be read in connection with the accompanying drawings.

BRIEF DESCRIPTION OF THE DRAWINGS

Other objects, features, and advantages of the present invention will become more apparent from the following detailed description of the preferred embodiment and certain modifications thereof, in which.

DETAILED DESCRIPTION OF THE PREFERRED EMBODIMENTS

The present invention is an improved protective helmet.

Figure 1:
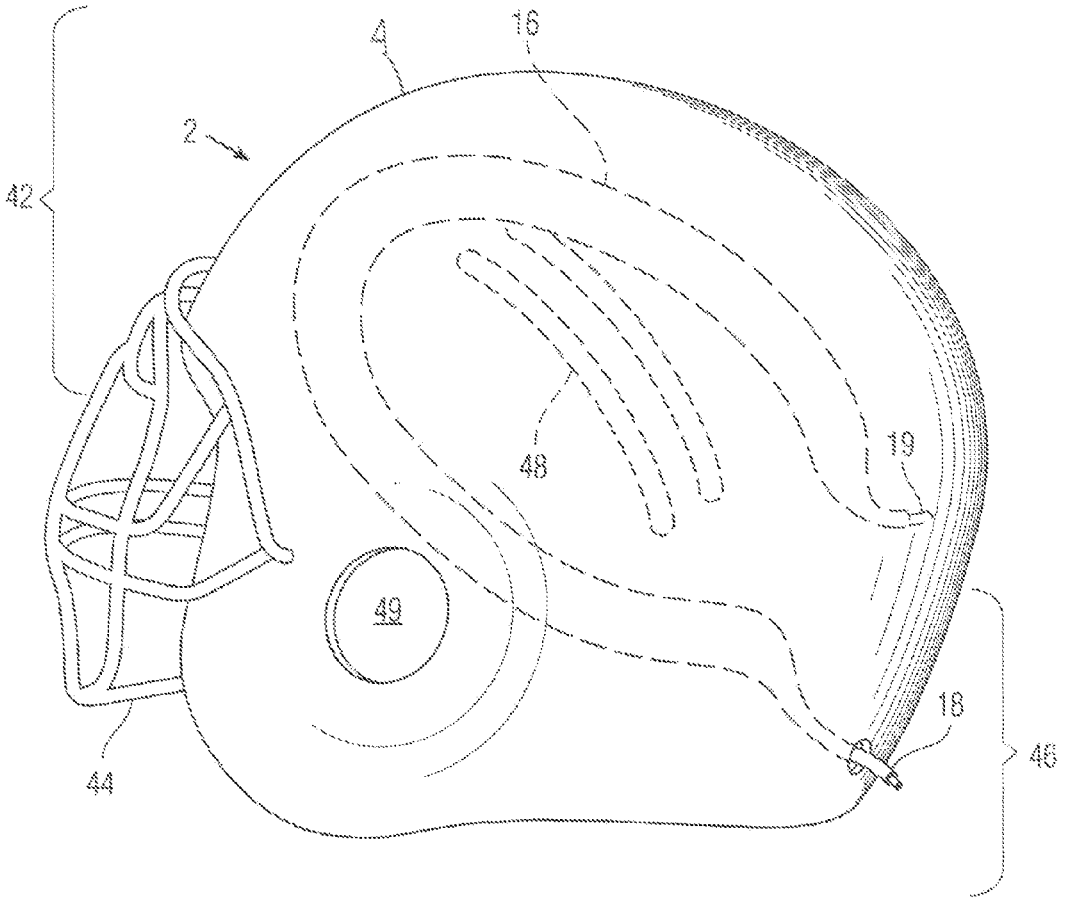
FIG. 1 is a side-perspective view of a football helmet 2 according to a first embodiment of the present invention.

FIG. 1 is a side-perspective view of the helmet according to a first embodiment which is a football helmet 2. Football helmet 2 generally comprises a hard molded plastic outer shell 4, and an internal inflatable bladder 16 with an inflation valve 18. In addition, one or more fixed internal foam pads 40 are included, and mesh cotton net 50 is provided overtop the bladder 16 for more comfortable skin contact (see FIG. 3).

The outer shell 4 is preferably constructed of a hard plastic material formed from conventional injection molding process as a single unitary piece. In a preferred embodiment the outer shell 4 is formed of acrylonitrile butadiene styrene, but may alternately be formed of any material that provides sufficient hardness and force resistant characteristics. The outer shell 4 has an upper crown portion 42, and a lower ear/neck protective portion 46. A front cage/visor portion 44 is attached separately. The upper crown portion 42 is intended to cover the crown of a wearer's head, while the lower portion 46 is intended to cover the upper back, sides and ears of a wearer's head. The cage/visor portion 44 protrudes frontally above the wearer's eyes for protection thereof. The exact configuration of the shape of the upper crown portion 42, visor portion 44, and the lower portion 46 is not limited to the shapes shown. Any of the outer shell 4 portions 42, 44, 46 may optionally include one or more vent openings 48 formed therein w allow air to circulate. In addition, the lower portion 46 of the outer shell 4 also has one or more ear holes 49 formed in both sides thereof to allow hearing and ventilation to the wearer's head.

The bladder 16 comprises a long thin rubber tube having valve 18 mounted centrally at mid-length. The bladder 16 is mounted inside the outer shell 4 with valve 18 protruding outwardly through a hole (described below) through the lower portion 46 at a rearward position directly beneath the occipital lobe. The bladder 16 runs in two equal-length elliptical patterns one on each side of the head. Each fluidic pattern comprises a semi-ellipse, running continuously from the valve 18 up to the temple and looping up and around from temporal-to-frontal-to-parietal sections of the human head, and having a terminus 19 approximately at the occipital portion.

Figure 2:
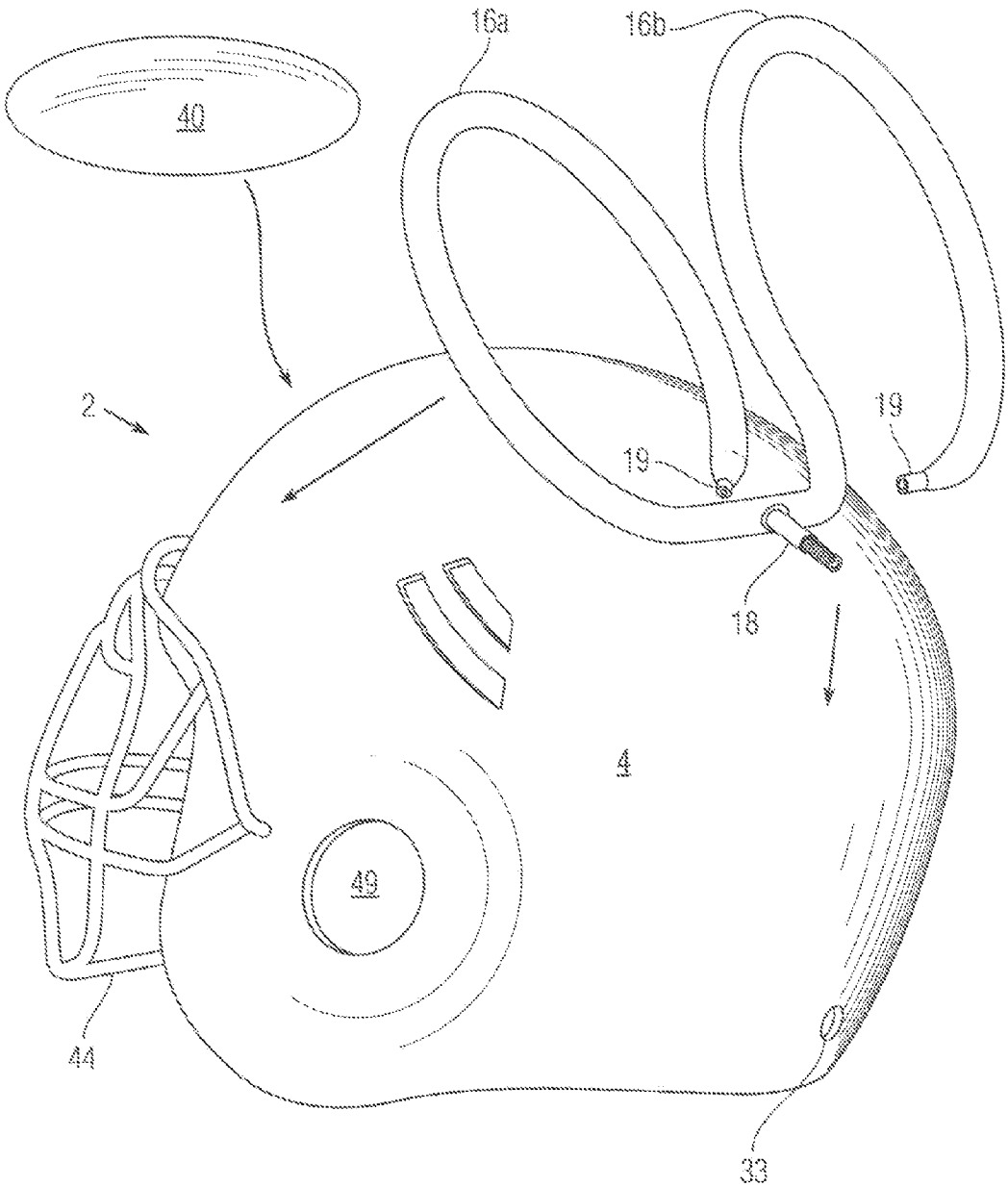
FIG. 2 is a rear-perspective exploded view of the football helmet 2 of FIG. 1.

FIG. 2 is a rear-perspective exploded view of the football helmet 2 of FIG. 1.

The tube 16 is a long thin rubber tube having valve 18 mounted centrally at mid-length. The bladder 16 is preferably formed of lightweight elastic TPE (thermoplastic elastomer compound) a highly-polymerized un-vulcanized rubber. If the bladder 16 is punctured, the TPE will form air-tight seal retarding leak speed, thereby preventing immediate deflation and improving safety for the wearer. The TPE material density is approximately 0.88 g/cm3, which is 30% lighter than traditional rubber tubes. When inflated, each section or lobe 16A, 16B of the bladder has a constant circular cross-section within an acceptable range of from 0.5-2.5" diameter, and most preferably within a range of between 1.95-2.25" diameter. The bladder 16 may be sealed at its two distal ends by constricted cable ties 19 or other suitable means.

As seen in FIG. 2, the bladder 16 is mounted inside the hard plastic shell 4 such that the valve 18 protrudes centrally through a hole 33 in the hard shell 4 and outward at a position just beneath the occipital bone at the rear of the wearer's head. The bladder branches from valve 18 into equal-length non-return fluidic patterns one 16B on the right-side of the head and one 16A on the left. Each fluidic pattern comprises a semi-ellipse, patterned and dimensioned to run continuously up to the temple and looping up and around from temporal-to-frontal-to-parietal sections of the head and terminating approximately back at the occipital portion. The bladder sections 16A, 16B are preferably bonded with an acrylic-based glue directly to the inner surface of the hard shell 4.

Valve 18 may be a conventional presta valve (also called Sclaverand valve or French valve) with outer valve stem and an inner valve body. A lock nut may be used to secure the valve 18 to hard shell 4 at the stem, and a valve cap may also be provided.

As mentioned above, one or more inserts of compressible padding 40 may be likewise adhered inside the hard shell 4 covering portions of the head in areas between and/or around the bladder 16. Preferably, at least one round, oval or rectilinear foam pad 40 is positioned between the lobes 16A, 16B of the bladder at the top front of the head. The padding 40 may be any suitable compressible layer, for example, a foam (e.g., open or closed cell) or an elastomer. If desired, the padding 40 may have a textured surface, with raised portions of the textured surface contacting the wearer's head and depressed portions of the textured surface improving breathability and holding perspiration. Padding 40 exists to provide a failsafe layer of protection in case the bladder 16 collapses during severe impact beyond a predetermined threshold.

In addition, mesh netting is provided over the bladder 16 as a liner layer against the head.

Figure 3:
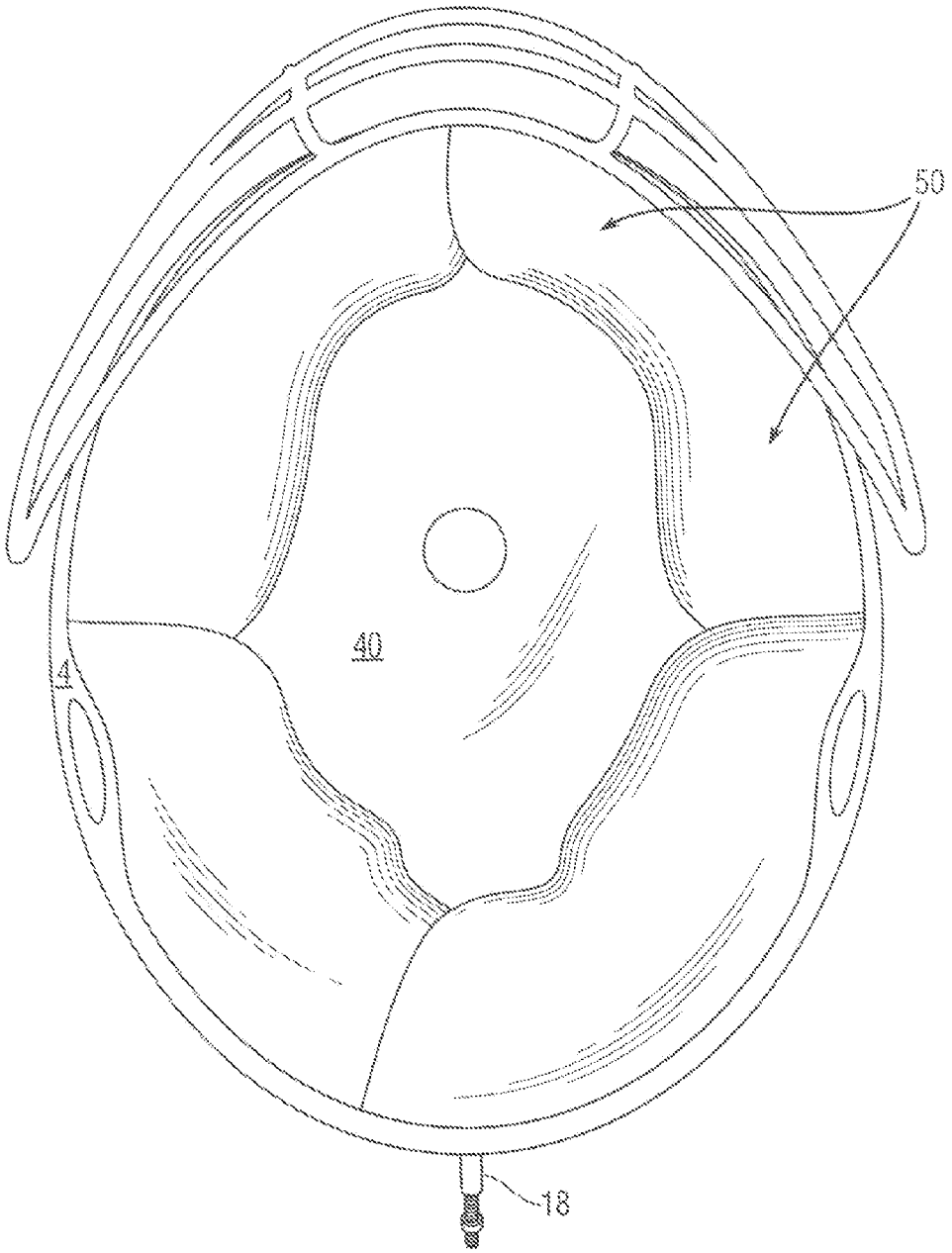
FIG. 3 is a bottom-perspective view of the football helmet 2 of FIGS. 1-2.

FIG. 3 is a bottom-perspective view of the football helmet 2 of FIGS. 1-2 with cage 44 removed and showing the mesh netting 50. Netting 50 comprises a 3 mm layer of cotton weave with antibacterial coating. Netting 50 may be removably attached by hook-and-loop inserts to allow washing. The netting 50 is high elasticity, moisture permeable, and mold-proof to likewise improve airflow and breathability and hold perspiration.

In use, the helmet 2 is first placed on the wearer's head. The bladder 16 is inflated via valve 18 to its fully-inflated 1.95-2.25" diameter using, an air pump or other suitable pressure source. Air is pumped continuously into the bladder 16 along the elongate pathway of the strip until the helmet 2 is securely seated. One skilled in the art will understand that inflation may be adjusted as desired to accommodate variation in head size.

Head impacts are typically localized and the elongate elastic-elliptical bladder 16 absorbs the localized energy of impact force. The air in bladder 16 is forced away from the area of impact into the extremities of bladder 16, and the thin tubular construction retard airflow slightly dissipating that energy slowly over an expanded area. Thus any one point of the head is spared the full force of the impact, thereby reducing the chance of injury. A significant testing protocol demonstrated improved performance statistics over prior an helmets.

The present invention provides a simple, durable, reliable and economical inflatable liner system which facilitates size variation of a helmet without sacrificing protection of the user's head. It has been found that an inflatable liner which completely encircles the head, as shown by the prior art, is unnecessary for providing adequate protection or size variation. By permitting a single helmet shell to be retrofitted to a wide range of head sizes, the present invention provides tremendous cost savings to the consumer. Consequently, an athletic institution, for example, may reuse a large stock of helmets each season without having to purchase extra helmets to custom fit unusual head sizes and shapes. Because few helmet shell sizes (children through adult) would be necessary, tooling costs for manufacturing custom helmets would also be greatly reduced.

The invention vastly improves impact protection yet is lightweight flexible, and comfortable to wear on a continuous basis. Extensive testing has confirmed that the particular elliptical fluidic circuit through materials of particular elasticity dissipates impact transfer to a greater extent, thereby improving protection. In addition, the improved fluidic-transfer helmet is lightweight, flexible, and comfortable against the skin, provides adequate ventilation allowing the user to dissipate heat and moisture, and is more comfortable to wear on a continuous basis.

In a further embodiment of the present invention, the hard shell 4 may be configured as a football helmet, hockey helmet, motorcycle helmet, or any other type of helmet.

One skilled in the art should readily understand that manufacturing methods and materials may vary. In all cases the benefit achieved is a helmet with inner dynamic padding that provides adaptive cushioning at the area of impact. The particular elliptical pattern dissipates impact transfer to a greater extent, thereby improving protection. Specifically, impact to the head at a particular spot will be immediately dampened by the inflated bladder underlying that spot. However, as the bladder compresses at that spot is pumps more air to the other lobe. This way, when the brain rebounds and moves rapidly in the opposite direction, and compresses against the skull on the opposing side, the other lobe is fully inflated and provides needed damping. This dynamic padding is more effective than conventional static padding which fails to provide adaptive cushioning that anticipates the area of impact.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. In particular, one skilled in the art will readily understand that the invention may be embodied in other helmet types without departing from the scope or spirit of the invention, including baseball, football, hockey, motorsports, or most any other protective helmet. It is to be understood, therefore, that the invention may be practiced otherwise than as specifically set forth in the appended claims.

We claim:

1. A protective helmet, comprising:

a hard plastic shell having a front, opposing sides, and a rear, and a hole there through at said rear adapted to be positioned proximate an occipital bone of a wearer; and an internal inflatable rubber bladder comprising an elongate rubber tube having a length and a constant circular cross-section along its entire length with constant diameter within a range of between 1.95-2.25", sealed at opposing ends, and a valve equidistant from said opposing ends, the inflatable rubber bladder being configured inside said hard plastic shell with equal-length branches defining two identical diametric lobes on said opposing sides of said hard plastic shell and joined together at said rear, said valve being mounted in the hole of said hard plastic shell.

2. The protective helmet of claim 1, wherein said internal inflatable rubber bladder comprises TPE rubber.

3. The protective helmet of claim 1, wherein said internal inflatable rubber bladder two identical diametric lobes extending on either side of said valve, each lobe being affixed to an inner surface of said hard plastic shell and defining a semi-elliptical fluidic circuit.

4. The protective helmet of claim 3, wherein each said lobe comprises a semi-ellipse running continuously up to a temple of said wearer and looping up and around from temporal-to-frontal-to-parietal sections of a wearer's head, and terminating approximately at an occipital portion of said wearer's head.

5. The protective helmet of claim 3, said valve protrudes centrally through the hard plastic shell outward proximate an occipital bone located at a rear portion of the wearer's head.

6. The protective helmet of claim 1, further comprising at least one compressible foam pad mounted inside said hard plastic shell between said internal inflatable bladder lobes.

7. The protective helmet of claim 1, wherein said bladder is adhered inside said hard plastic shell.

8. The protective helmet of claim 7, further comprising a section of mesh netting provided over the bladder to serve as a liner layer adapted to be against the head.

9. The protective helmet of claim 7, wherein said bladder comprises two identical lobes extending on either side of said valve, each lobe shaped as a semi-ellipse running continuously up to the wearer's temple and looping up and around from temporal-to-frontal-to-parietal sections of the wearer's head, and terminating approximately at the occipital bone of the wearer's head.

10. The protective helmet of claim 7, wherein said valve is presta valve.

11. A protective helmet, comprising:

a hard plastic shell;

an internal inflatable bladder comprising a long thin rubber tube having a length and two identical diametric lobes each defining a semi-elliptical fluidic circuit, said bladder being mounted inside the hard plastic shell, each fluidic circuit comprising a semi-ellipse running continuously up to a temple of a wearer and looping up and around from temporal-to-frontal-to-parietal sections of a head of said wearer, and terminating approximately at the occipital portion;

a valve mounted centrally at mid-length of said bladder and bisecting said bladder into non-return fluidic circuits, said valve protruding centrally through the hard shell outward proximate an occipital bone at the rear of the wearer's head;

at least one compressible foam pad mounted inside said hard plastic shell between said internal inflatable bladder lobes;

a section of mesh netting over the bladder as a liner layer against the head; wherein the rubber tube has a constant circular cross-section diameter along its entire length.

12. The protective helmet of claim 11, wherein said bladder constant circular cross-section diameter is within a range of between 1.5-1.75".

13. The protective helmet of claim 11, wherein said bladder comprises TPE rubber.

14. The protective helmet of claim 13, wherein said internal inflatable rubber bladder comprises two identical diametric lobes extending on either side of said valve, each lobe being adhered against an inner surface of said hard plastic shell and defining a semi-elliptical fluidic circuit.

15. The protective helmet of claim 14, wherein each said lobe comprises a semi-ellipse running continuously up to a temple of said wearer and looping up and around from temporal-to-frontal-to-parietal sections of a wearer's head, and terminating approximately at an occipital portion of said wearer's head.

16. The protective helmet of claim 15, wherein said valve protrudes centrally through the hard plastic shell outward proximate an occipital bone at the rear of the wearer's head.

17. The protective helmet of claim 11, further comprising at least one compressible foam pad mounted inside said hard plastic shell between said internal inflatable bladder lobes.

18. The protective helmet of claim 11, wherein said bladder is adhered inside said hard plastic shell.

19. The protective, helmet of claim 17, further comprising a section of mesh netting provided over the bladder to serve as a liner layer against the head.

* * * * *